US010395566B2

(12) United States Patent
White

(10) Patent No.: US 10,395,566 B2
(45) Date of Patent: Aug. 27, 2019

(54) OFFSET DISPLAY HOLDER WITH C-CHANNEL

(71) Applicant: Michael J. White, Ripon, WI (US)

(72) Inventor: Michael J. White, Ripon, WI (US)

(73) Assignee: K-International, Inc., Waukegan, IL (US)

( * ) Notice: Subject to any disclaimer, the term of this patent is extended or adjusted under 35 U.S.C. 154(b) by 367 days.

(21) Appl. No.: 14/664,569

(22) Filed: Mar. 20, 2015

(65) Prior Publication Data

US 2016/0275829 A1 Sep. 22, 2016

(51) Int. Cl.
*G09F 7/18* (2006.01)
*G09F 15/02* (2006.01)

(52) U.S. Cl.
CPC ..... *G09F 7/18* (2013.01); *G09F 15/025* (2013.01); *G09F 2007/186* (2013.01); *G09F 2007/1852* (2013.01)

(58) Field of Classification Search
CPC .. G09F 7/18; G09F 15/025; G09F 2007/1852; G09F 2007/186; G09F 7/10; G09F 3/20; G09F 7/02; G09F 7/12
USPC ..... 248/317, 323, 327
See application file for complete search history.

(56) References Cited

U.S. PATENT DOCUMENTS 2,867,926 A * 1/1959 Cutler ..... G09F 7/10 248/251
4,262,436 A * 4/1981 Clement ..... G09F 3/20 40/490
4,344,244 A * 8/1982 Tyke ..... G09F 3/18 40/490
4,357,773 A * 11/1982 Dennis ..... G09F 7/02 40/606.18
4,593,486 A * 6/1986 Visocky ..... G09F 3/20 40/490
4,641,448 A * 2/1987 Cobb ..... G09F 7/18 40/607.02
4,698,928 A * 10/1987 Soporowski ..... G09F 3/20 40/605
4,821,437 A * 4/1989 Abramson ..... G09F 1/10 40/651
4,884,351 A * 12/1989 Abramson ..... G09F 13/16 40/606.19
5,090,145 A * 2/1992 Chiang ..... A47G 1/065 40/605

(Continued)

OTHER PUBLICATIONS

Co-pending Design U.S. Appl. No. 29/519,473, filed Mar. 5, 2015, Inventor Michael J. White.

*Primary Examiner* — Kimberly T Wood
(74) *Attorney, Agent, or Firm* — Schiff Hardin LLP

(57) ABSTRACT

A display holder includes an extruded member having a top surface from which extends a T-shaped grip portion for engagement by a gripper at the end of a pole. Spaced from the grip portion is a brace on the end of which is a web connected to a C-channel. The C-channel receives a display or sign such as a dowel in a sleeve of the display which allows the user to maximize sign size, head space or lines of sight. The C-channel also can be used to receive a block end hook, a cord suspender, or a clip. A ring may be provided through a hole in the web. The display holder is mounted or un-mounted safely from floor level in one single motion to a ceiling by magnets on the top surface or to a wall by magnets on the brace.

19 Claims, 10 Drawing Sheets

(56) References Cited

U.S. PATENT DOCUMENTS

| | | | | | |
|---|---|---|---|---|---|
| 5,188,332 | A * | 2/1993 | Callas | G09F 7/18 | 248/206.5 |
| 5,381,991 | A * | 1/1995 | Stocker | G09F 7/18 | 248/206.5 |
| 5,409,191 | A * | 4/1995 | Wenmaekers | E04B 9/006 | 248/317 |
| 5,806,823 | A * | 9/1998 | Callas | G09F 15/025 | 248/317 |
| 6,048,010 | A * | 4/2000 | Stocker | A47F 13/06 | 248/343 |
| 7,373,748 | B2 * | 5/2008 | Pitcher | G09F 7/00 | 24/462 |
| 7,823,311 | B2 * | 11/2010 | Pitcher | G09F 7/10 | 40/618 |
| 8,689,474 | B2 * | 4/2014 | Garfinkle | G09F 7/10 | 40/611.05 |
| D715,632 | S | 10/2014 | White | | |
| D742,970 | S | 11/2015 | White | | |
| D749,404 | S | 2/2016 | White | | |
| D749,405 | S | 2/2016 | White | | |
| 9,697,754 | B2 * | 7/2017 | White | G09F 7/18 | |
| 2003/0070337 | A1 * | 4/2003 | Music | G09F 7/10 | 40/618 |
| 2007/0209261 | A1 * | 9/2007 | Stover | G09F 7/18 | 40/617 |
| 2009/0056186 | A1 * | 3/2009 | Pitcher | G09F 7/18 | 40/617 |
| 2009/0211135 | A1 * | 8/2009 | Garfinkle | G09F 7/10 | 40/611.05 |
| 2013/0263486 | A1 * | 10/2013 | Logan | G09F 7/18 | 40/607.13 |
| 2015/0262516 | A1 | 9/2015 | White | | |
| 2016/0203741 | A1 | 7/2016 | White | | |
| 2016/0265718 | A1 | 9/2016 | White | | |
| 2016/0275828 | A1 | 9/2016 | White | | |
| 2016/0275829 | A1 | 9/2016 | White | | |
| 2017/0103686 | A1 | 4/2017 | White | | |

* cited by examiner

OFFSET DISPLAY HOLDER WITH C-CHANNEL

BACKGROUND OF THE INVENTION

Field of the Invention

The present invention relates generally to a display holder for suspending a sign or display, and more particularly to a display holder for attaching a sign or display to a wall, ceiling, window, or other location.

Description of the Related Art

Stores, restaurants, public facilities, offices, schools, theaters, and other facilities or places of business often utilize temporary signs or displays to convey information, such as announcing sales or events, providing location information, or providing directions. The signs or displays may be in the form of banners, posters, signs, or other displays and may be mounted prominently for viewing by customers, users, workers or others. The displays may be mounted to a ceiling of the facility or to a wall, window or other prominent mounting location.

Attaching displays at prominent locations may require that a person mounting the display climb a ladder or step stool, climb on a box or crate, step up on a chair or a restaurant booth or a stool, or otherwise climb to reach the mounting location. Climbing to reach mounting locations increases the risk of falls or injury.

Displays mounted to a ceiling or other prominent location may require mounting hardware that results in the sign or other display being suspended a distance below the hardware that is attached to the ceiling and thus causing a gap or space between the ceiling and the sign or display. The gap or space may be necessary to provide access to hardware that is attached to the ceiling, however, the requirement for a space between the suspended sign and the ceiling thus often times limits the size of the sign or display. In facilities with lower ceiling heights, for example, a sign suspended a distance below the mounting hardware may need to be smaller in size to provide clearance for the mounting hardware yet avoid hanging low enough to interfere with head clearance in the facility. A sign that is too large may strike someone in the head or block desirable lines of sight. Often times clear lines of sight are important to prevent shoplifting or theft, especially in low ceiling height environments such as gas stations or convenience stores.

SUMMARY OF THE INVENTION

The present invention provides an apparatus and method for mounting or un-mounting a sign or other display using a channel that provides versatile mounting options. The sign or display may be mounted or un-mounted without requiring a gap or space between the sign and the mounting hardware thus maximizing the size of the sign or yielding additional head space clearance or sight lines. The apparatus and method herein further provides the option of the sign being mounted or un-mounted with mounting hardware providing clearance between the sign and the mounting hardware, if so desired. The sign or display may be mounted or un-mounted in a prominent location without requiring that the user climb to reach the mounting location. The apparatus and method herein permits the sign or display to be mounted to or urn-mounted from a prominent vertical or horizontal surface safely from the floor level. The apparatus and method permits the sign or display to be mounted or un-mounted with one single motion, even with multiple hanging points, if desired.

DETAILED DESCRIPTION OF THE PREFERRED EMBODIMENTS

Figure 1:
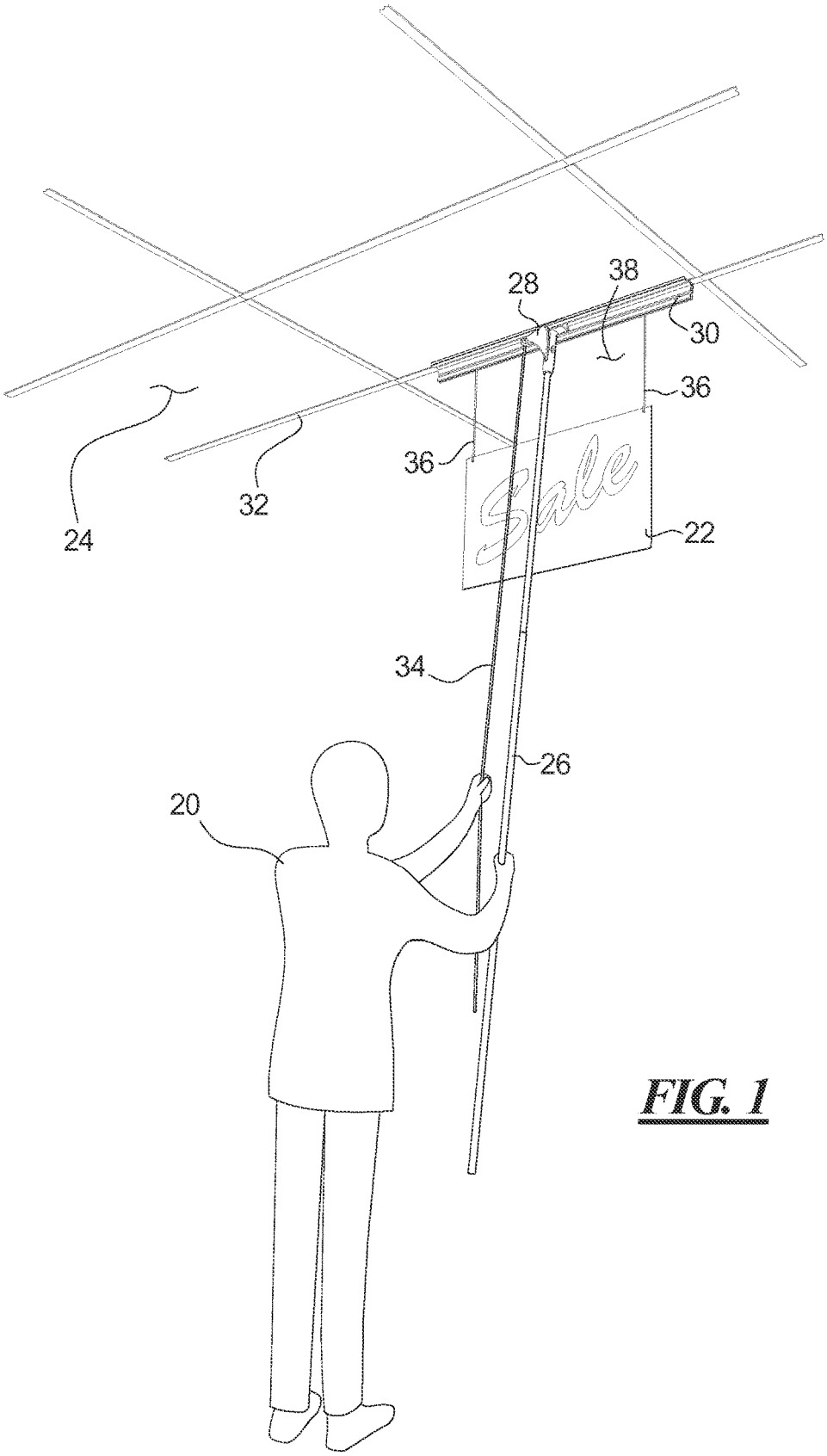
FIG. 1 is a perspective view of a user mounting a sign or display to a grid ceiling using the present apparatus.

In FIG. 1, a user 20 is shown mounting or un-mounting a sign or display 22 to a ceiling 24 so that the sign or display 22 is prominently positioned for easy viewing. The user is using a pole 26 with a gripper 28 at the end to engage an offset display holder 30 from which the sign or display 22 is hung. The gripper 28 engages the offset display holder 30 using an internal spring to urge gripping jaws closed. Once the user has positioned the display 22 at a desired mounting location, the offset display holder 30 magnetically engages a grid element 32 of the ceiling 24. With the offset display holder 30 magnetically engaged, the user pulls a cord 34 to open the jaws of the gripper 28 and release the offset display holder 30. The user 20 may then move the pole 26 and gripper 28 away, leaving the display 22 at the mounted position. The mounting of the display 22 to the ceiling may be accomplished with one single motion and without the use of a ladder, step stool, chair, crate, or other item for the user to climb on. The user may position the display 22 at a prominent display position while keeping the user's feet on the ground, reducing the risk of falling or injury.

A single lifting motion for mounting a sign or display 22, even a sign with multiple hanging points, is possible using a single lifting pole 26 by a single user 20. A single removing motion for un-mounting the sign or display using a single lifting pole by a single user is also possible.

Removing the display 22 from the ceiling 24 is accomplished by the user 20 moving the gripper 28 on the end of the pole 26 to the offset display holder 30. The user 20 pulls the cord 34 to open the jaws of the gripper 28 and positions the gripper 28 to grasp the offset display holder 30. By releasing tension on the cord 34, the gripper 28 engages the offset display holder 30. The user 20 may then use the pole 26 to disengage the magnetically engaged offset display holder 30 from the ceiling grid 32. The display holder 30 with the display 22 held in it is then moved to a convenient location for removing the sign or display 22 from the holder 30. The removal of the sign or display 22 may be accomplished with one single motion and without the need for the user 20 to climb a ladder or other apparatus.

As may be readily understood, the user 20 may engage the display holder 30 and reposition the display 22 at the ceiling, for example to face a different direction or to align the display, or may relocate the display 22 to a different position within the facility using the ladderless un-mounting and mounting steps and apparatus as described above—all with one single motion.

The sign or display 22 is suspended below the display holder 30 by suspender elements 36 that provide a gap 38 between the display 22 and the display holder 30. The use of suspender elements 36 that result in the gap 38 is acceptable for facilities with high ceilings 24 and/or when hanging small displays 22 or when head clearance is not a concern. The display holder 30 permits the user 20 to use suspender elements 36 when desired. The display holder 30 also permits the display 22 to be mounted to the display holder 30 without a gap 38 and with the display 22 connected directly to the display holder 30, as will be described. The display holder 30 is shaped to provide a grip location for the gripper 28 without requiring the gap 38 to engage the display holder 30.

Figure 2:
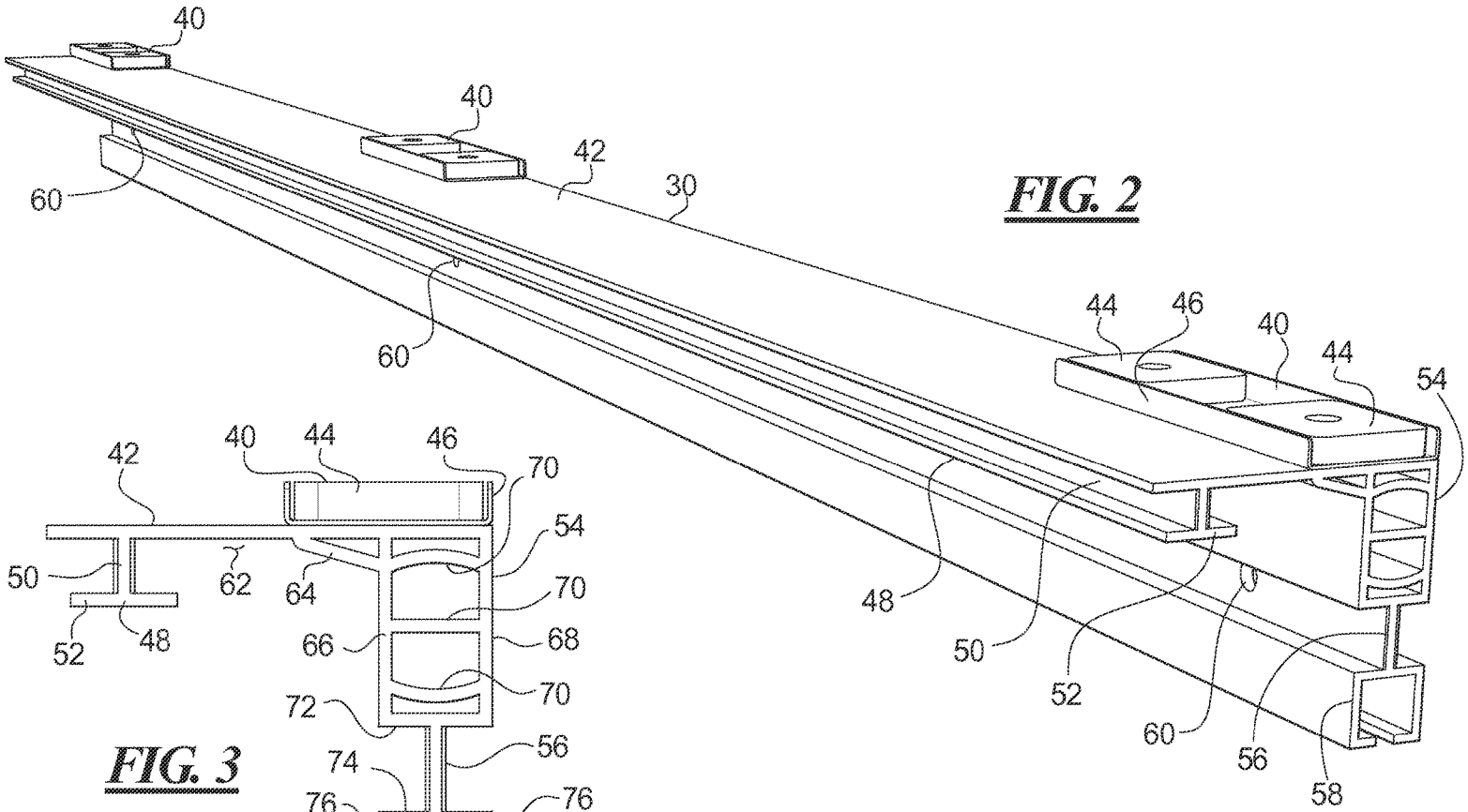
FIG. 2 is a perspective view of an offset display holder having a C-channel.

Turning to FIG. 2, the display holder 30 of the illustrated embodiment is an elongated member having a plurality of magnets 40 mounted on a top surface or top plate 42. As will be described, other embodiments are possible with magnets mounted at other positions and locations. The magnets 40 of certain embodiments are formed of a pair of ceramic magnet portions 44 mounted in a steel channel 46. The illustrated magnets 40 provide a strong magnetic hold to the ceiling grid elements 32 or other ferromagnetic material. Other magnets, including strip magnets and magnets of other shapes, sizes and materials are possible.

On the opposite surface from the top surface 42, attached to the top plate, is a grip portion 48. The grip portion 48 is inverted T-shaped and includes a support web 50 and a cross web 52. The gripper 28 may grasp the grip portion 48, for example to mount and unmount the display holder 30. The support web 50 may be provided with rubber or vinyl coatings on one or both sides to increase the friction between the gripper 28 and the grip portion 48 to prevent slipping. The rubber or vinyl coatings may be provided on the support web 50 during extrusion forming of the holder 30.

Also on the opposite surface from the top surface 42 is a brace 54. The brace 54 extends to a web 56 that is connected to a C-channel 58. The web 56 of certain embodiments includes one or more holes 60. In certain embodiments, the web 56 includes rubber or vinyl coatings on one or both sides to increase the friction between the gripper 28 and the web 56, should the user apply the gripper 28 to the web 56. The coatings may be provided during extrusion of the holder 30. A sign, display, poster, or banner 22 may be mounted in the C-channel 58, either directly or using hardware to mount the display in or suspended from the C-channel 58, or the sign or display may be mounted using hardware connected through the holes 60.

Figure 3:
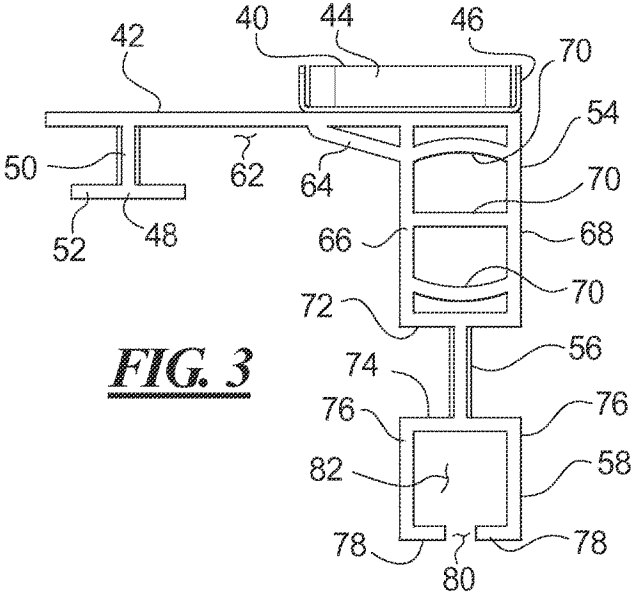
FIG. 3 is an end view of the offset display holder of FIG. 2.

Additional details of the display holder 30 are apparent in FIG. 3. The display holder 30 of certain embodiments is formed of an extruded member to which the magnets 40 are attached. The display holder may be formed of vinyl, plastic, corrugated material, wood, metal, or other material. The grip portion 48 is spaced from the brace 54 by a gap 62 that provides clearance for the jaw of the gripper 28 to grasp the grip portion 48. A gusset 64 extends from the top surface 42 to the brace 54. The brace 54 includes first and second parallel walls 66 and 68 between which extend cross supports 70. A bottom member 72 is connected to the web 56.

The C-channel 58 includes a top wall 74. Two side walls 76 extend from the top wall 74 to partial bottom walls 78. The partial bottom walls 78 are spaced apart from one another by a gap 80. The gap 80 leads into an interior space 82 of the C-channel 58. The top wall 74 of certain embodiments is flat and the overall shape of the C-channel is a square cross section. Other configurations and shapes of the C-channel are possible.

Figure 4:
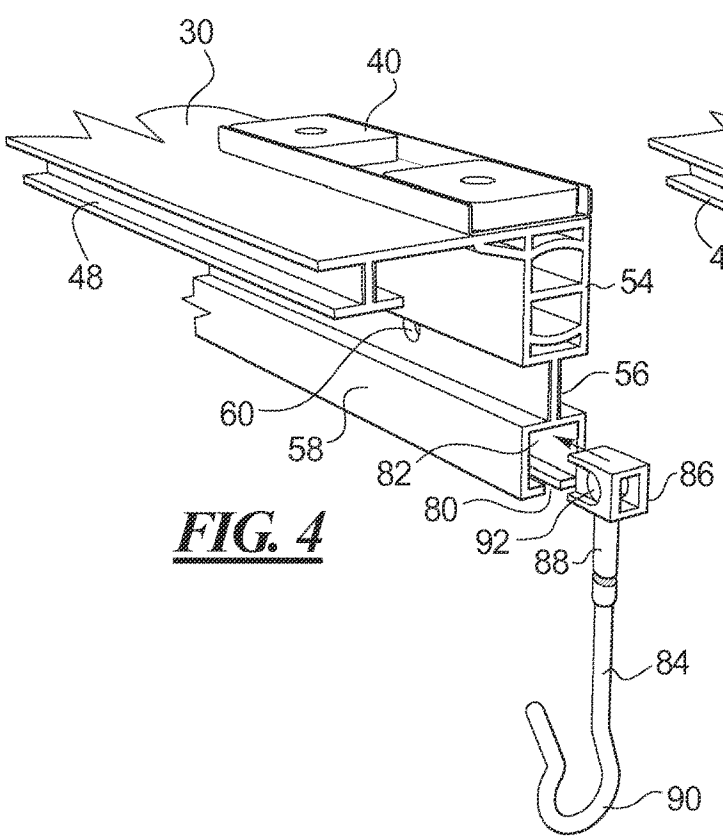
FIG. 4 is a perspective view of a portion of the offset display holder with a block end hook for holding a display.

In FIG. 4 is shown the display holder 30 to which is being mounted a block end hook 84. The block end hook 84 includes a block-shaped portion 86 of a size and shape to fit into the interior space 82 of the C-channel 58. A shaft 88 extends from the block 86 through the gap 80 so that the shaft 88 and a hook 90 extend out of the bottom of the C-channel 58. The block 86 and shaft 88 of certain embodiments are of a size and shape relative to the size and shape of the C-channel to frictionally engage in the C-channel 58 so that the user may position the hook 84 at a desired location and the hook 84 tends to stay at the desired location during mounting of the sign or display in a prominent location. One or a plurality of the block end hooks 84 may be provided in the C-channel 58, positioned as needed by sliding the blocks 86 of the block end hooks 84 along the inside of the C-channel 58. A sign or display or other item may be hung from the hooks 90, for example, prior to mounting the holder 30 at a prominent location. The block 86 of certain embodiments includes a hole 92 by which the block end hooks 84 may be connected together, for example by hooking the hole 92 of one block end hook 84 onto the hook 90 of another block end hook 84 to lengthen the distance, as desired, between the display holder 30 and the display 22. Block end hooks 84 of different lengths or with locking style hooks 90 may be provided.

Figure 5:
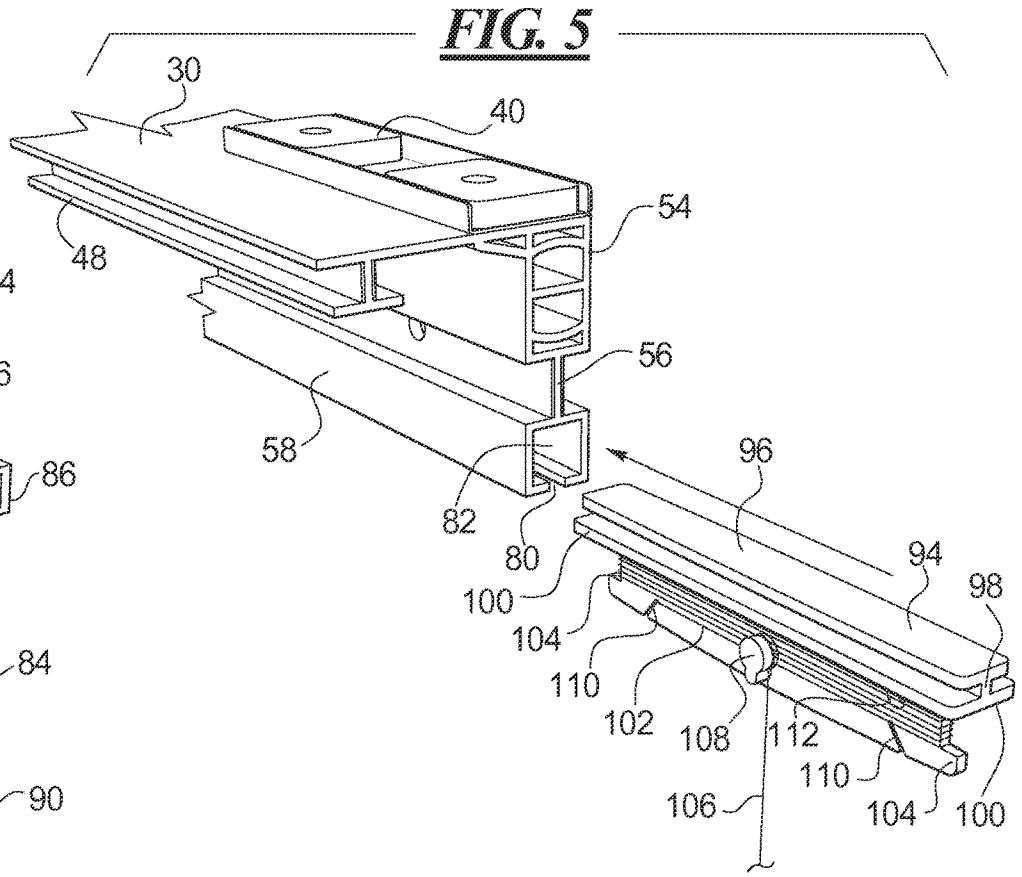
FIG. 5 is a perspective view of a portion of the offset display holder with a cord suspender for holding a display.

FIG. 5 shows a cord suspender 94 being mounted in the C-channel 58. The cord suspender 94 includes a top plate 96 that fits into the interior space 82 of the C-channel 58. A connecting web 98 extends through the gap 80. Support flanges 100 extend outward from the connecting web 98 to a position outside the C-channel 58. The C-channel 58 and the cord suspender 94 are shaped and sized to provide a friction fit that maintains the cord suspender 94 at a desired location along the C-channel 58. A cord support 102 extends from the support flanges 100. The cord support 102 includes end projections 104 that keep the cord 106, that has been wound on the cord support 102, from slipping off. The cord 106 is wound on or unwound from the cord support 102, as needed. A cord catch 108 holds the cord 106 to maintain the wound portion of the cord 106 on the cord support 102 while supporting a display 22 suspended from the free end of the cord 106. Slots 110 are formed into the cord support 102 to permit variations in the length of the unwound cord in intervals of less than one wrap on the cord support for even, level hanging of display 22 for when two or more cord supports 102 are used. A hole 112 is provided for anchoring an end of the cord 106.

One or several cord suspenders 94 may be provided in the C-channel 58 to provide a type of display referred to as a dangler display, which is most often used for small display elements, such as shaped cards, ornaments, or the like. Several cord suspenders 94 may be provided in the C-channel 58 connected to a single sign or display. The suspenders 94 may be frictionally moved at any desired position along the C-channel 58 so that display elements are suspended in a desired way from the display holder 30.

Figure 6:
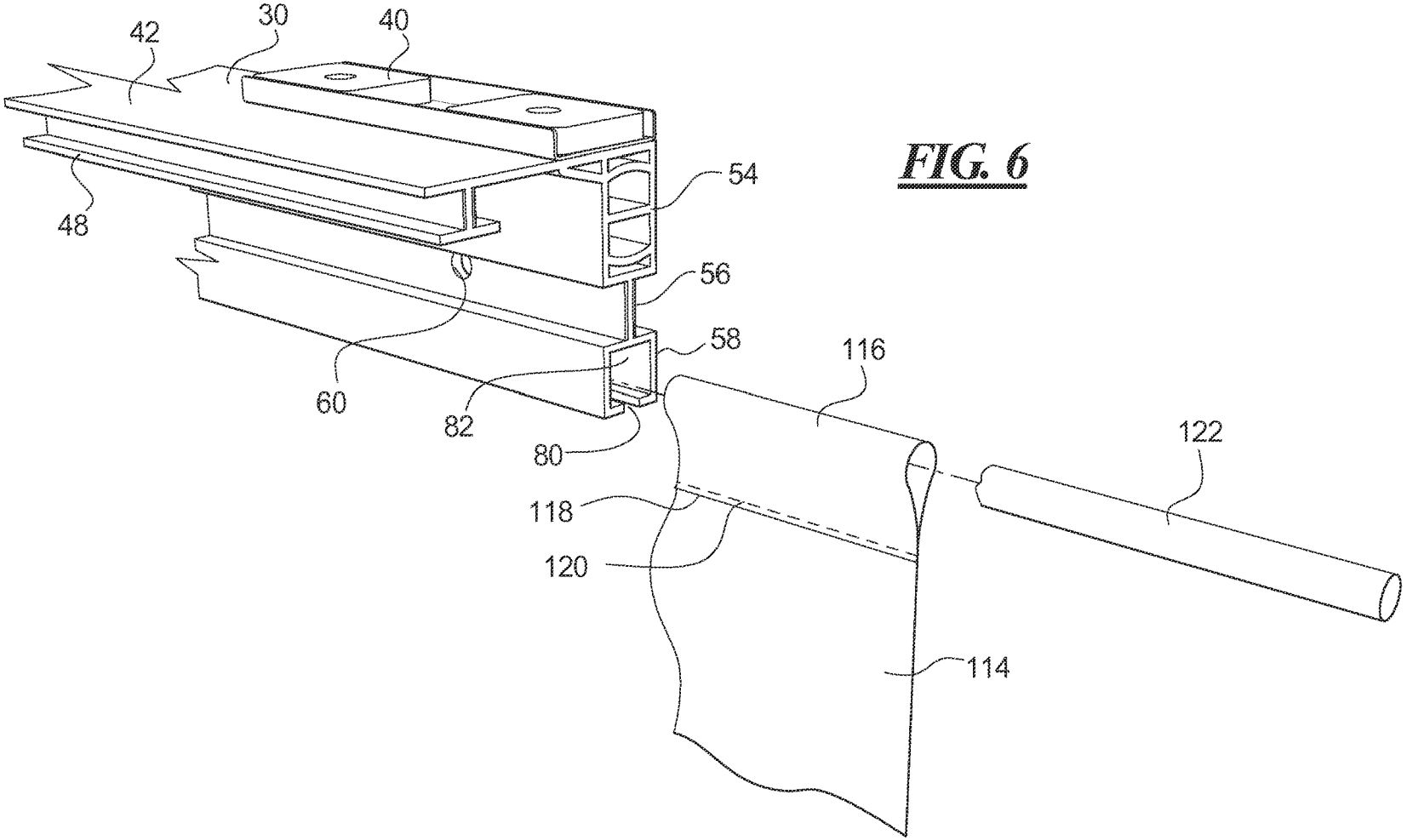
FIG. 6 is a perspective view of a portion of the offset display holder with a dowel for holding a display.

The display holder 30 may have a sign, banner or display hung directly from the C-channel 58 without a gap for suspending hardware. In FIG. 6 is shown a sign or banner 114 that has a top edge formed into a sleeve 116. The sleeve 116 may be formed by folding a top edge 118 onto the body of the sign or banner and fastening, sewing or hemming the top edge 118 to the body by stitching 120 or by adhesive, welding, heat forming, staples, or other fastening or bonding means. The sleeve 116 may be formed in the material of the sign or banner 114 or may be a separate part that is fastened to the sign or banner 114. A dowel 122 or other article is inserted into the sleeve 116 and the sleeve 116 with the dowel 122 inside is inserted into the interior space 82 of the C-channel 58 so that the banner or sign 114 extends through the gap 80. The dowel 122 is of a size that prevents the sign or banner 114 from slipping out of the C-channel 58 through the gap 80. The dowel 122 and C-channel 58 in combination also works to hold the sign or display in a straight, rigid and stabilized line rather than a wavy or bow-like shape that can be common with non-supported dowels over their full length, for example that may be bearing the weight of a banner over their full length with common support elements only being on both ends. The sign or banner or other display 114 is held in the C-channel without a gap 38 between the display holder 30 and the display 114. In this embodiment display space is maximized without loss of display space as a result of suspending hardware that forms a gap between the display holder 30 and the display 114.

The dowel 122 may be as long as the sleeve 116, or longer or shorter than the sleeve. The dowel 122 may be provided in one piece or in several pieces. The sleeve 116 may be continuous across the entire top of the sign or banner 114 or may be provided as sleeve portions at spaced locations along the top of the sign or banner. For example, regularly spaced tabs at the top of the sign or banner into which are formed sleeve portions through which the dowel 122 extends may be provided. A sign or display or banner 114 of paper, plastic, vinyl, fabric, non-woven web such as Tyvek, or other material may be held in the display holder using the dowel in the C-channel method. The dowel 122 may be cylindrical, square, rectangular, triangular, hexagonal, or other shapes. The dowel 122 may be formed of plastic, wood, glass, metal, or other material.

In certain embodiments of the display holder 30, the brace 54 and/or web 56 may be eliminated to bring the C-channel closer to the ceiling or other mounting location and thus maximize the size of the sign that is possible. The brace 54 may be provided in embodiments for mounting the magnets 40 to the brace and the web 56 may be provided in embodiments that utilize the holes 60 to hold hooks or rings, and thus provide more options. Other configurations of the holder are also possible to provide means of holding a sign or display 22, and thus maximizing the size of the sign 22, without the need for the space 36 and without the use of suspending hardware.

Figure 7:
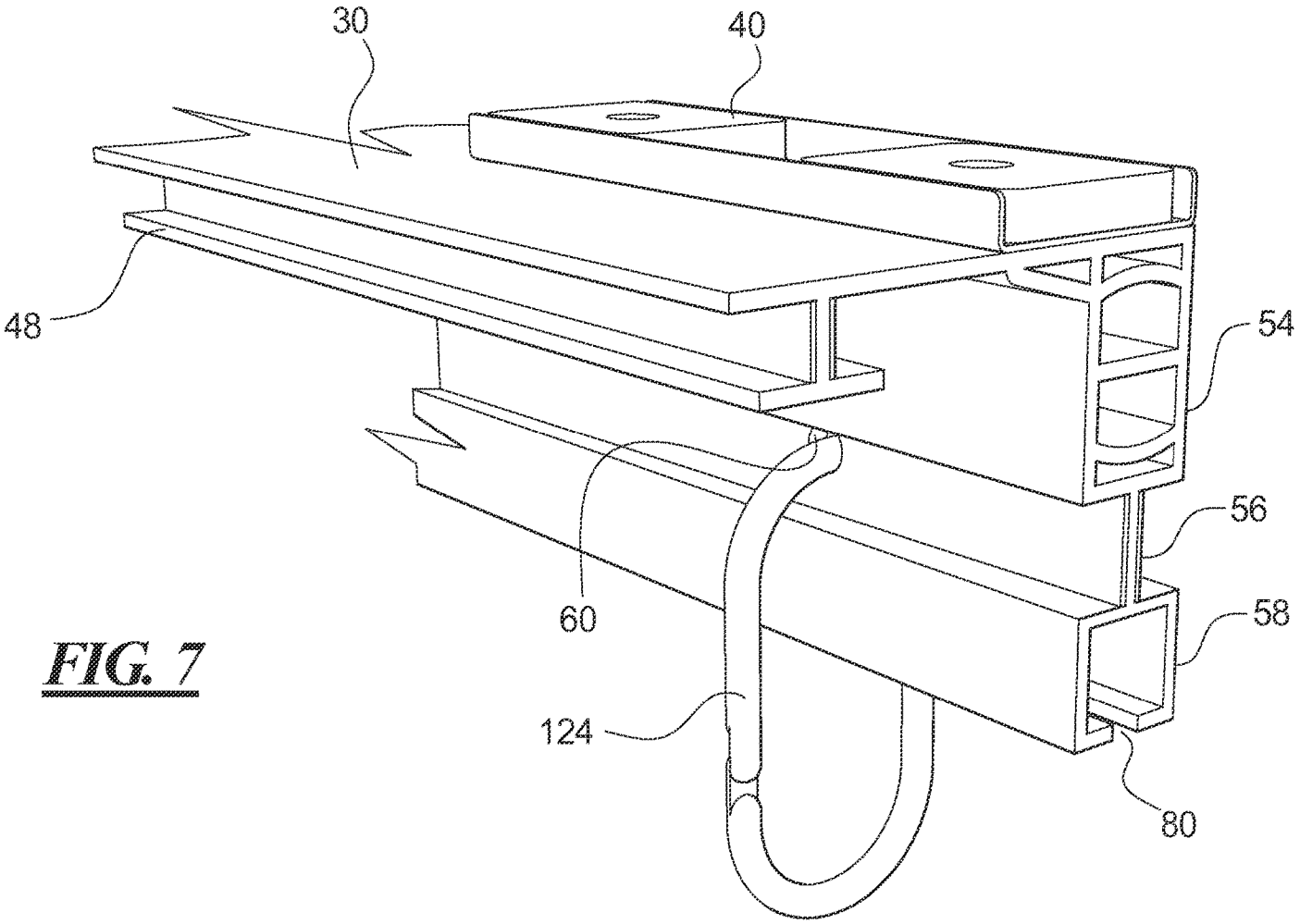
FIG. 7 is a perspective view of a portion of the offset display holder with a ring for holding a display.

FIG. 7 shows the holes 60 in the web 56 being used to mount or suspend a display or sign. A ring 124 is passed through the hole 60 by which a sign or display may be mounted. For example, a sign or other display may be suspended from the ring 124. A single ring 124 or multiple rings through multiple holes 60 may be provided. The ring 124 may be oval as shown or may be pear-shaped or may be round, or may be hooks that are S-shaped, J-shaped, C-shaped or other shapes having open ends or closed ends to mount or suspend a display or a sign thru the holes 60. The holes 60 may be connected to a string, chain, cord, wire, cable or other material or item for hanging a sign or display. Regardless of the sign or display hung from the display holder 30 and the means for suspending or hanging the sign, the gripper 28 may engage the offset grip portion 48 for mounting and unmounting with one single motion.

Figure 8:
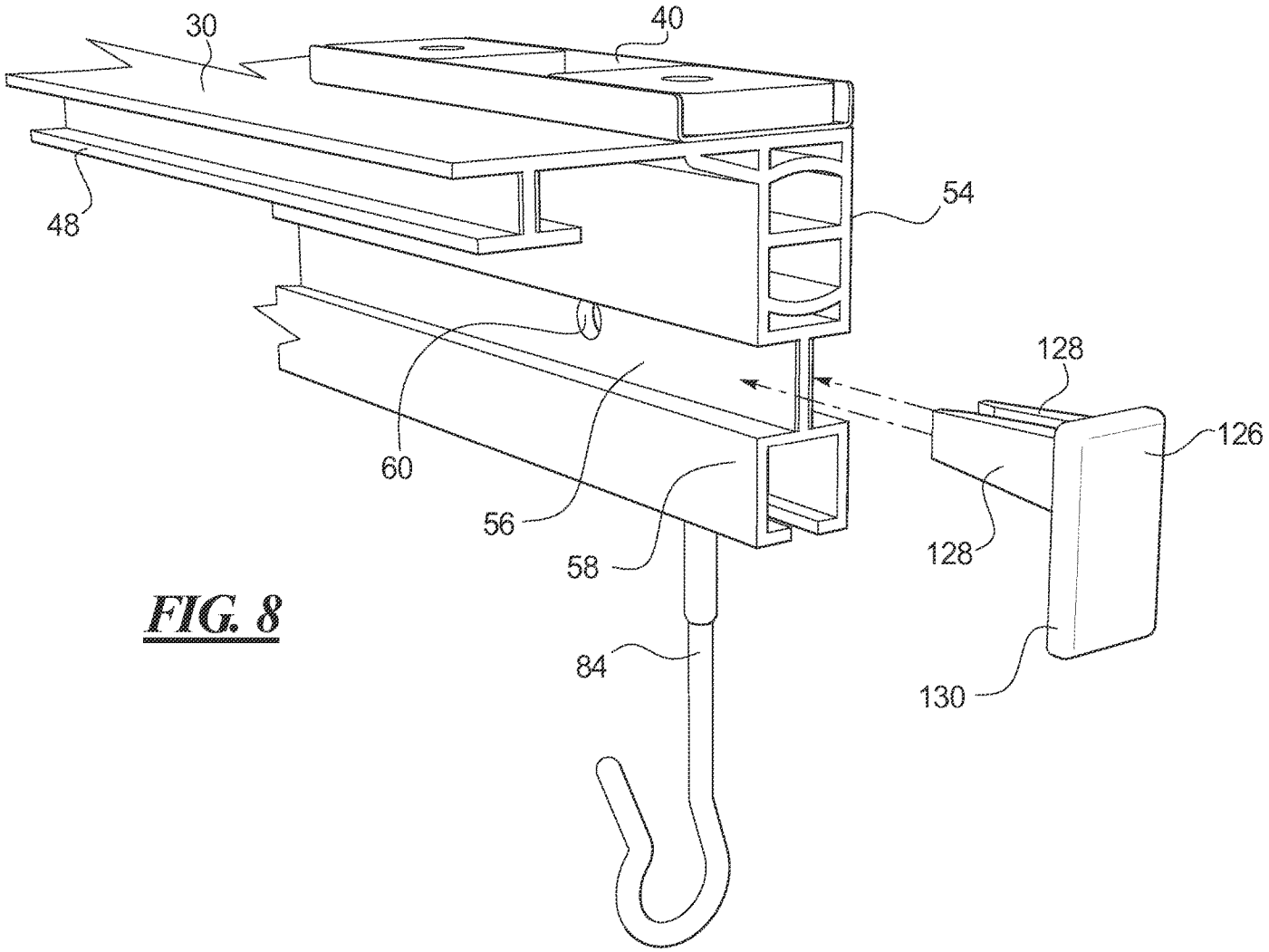
FIG. 8 is a perspective view of a portion of the offset display holder with an end cap.

FIG. 8 shows an end cap 126 that frictionally clips to the web 56 using arms 128 that extend on opposite sides of the web 56. The arms 128 grip the web 56 to hold an end plate 130 over an open end of the C-channel 58. In embodiments of the display holder 30 having the rubber or vinyl high friction surfaces on the sides of the web 56, the arms 128 provide a particularly firm grip. The end plate 130 prevents display hardware from slipping from the C-channel 58. For example, any of the hardware shown herein as well as others may be prevented from slipping out of the channel 58 by the end cap 126. The end cap 126 also provides a more finished appearance to the holder 30.

Figure 9:
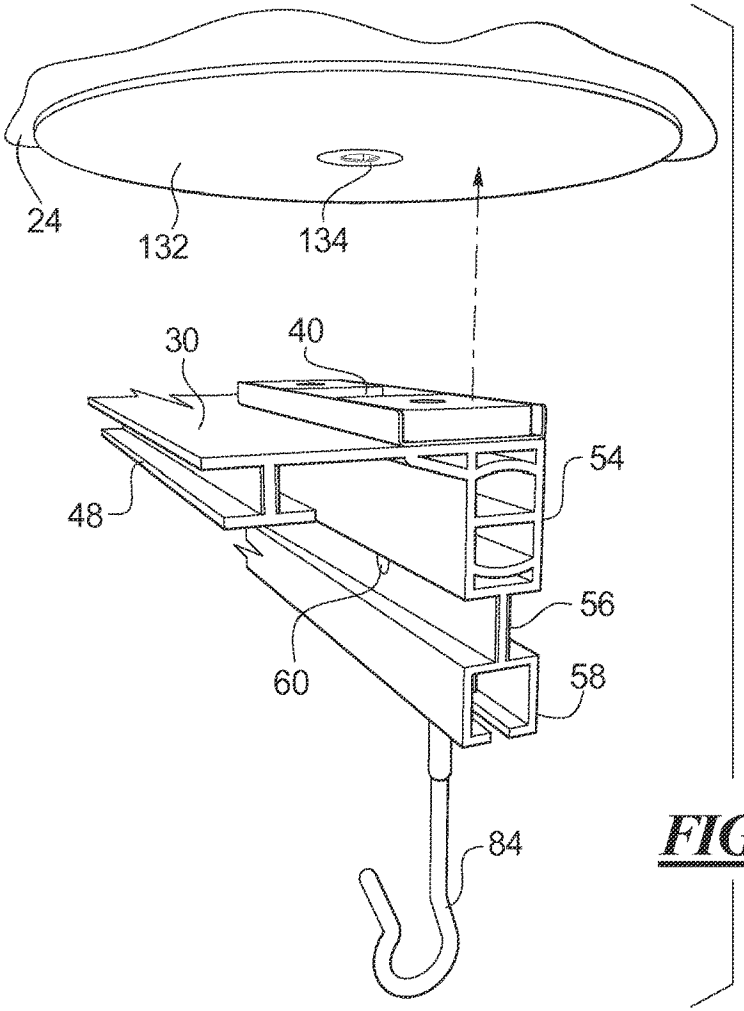
FIG. 9 is a perspective view of a portion of the offset display holder being mounted to a metallic ceiling disk.

With reference to FIG. 9, the magnets 40 of the display holder 30 may be mounted to one or more metal plates 132 mounted on a ceiling 24. The metal plate 132 is attached to a ceiling 24 by a screw or bolt 134. The screw or bolt 134 may include a wall anchor such as for mounting in dry wall or behind wood or other hollow wall materials. Other wall, soffit or ceiling mounting methods and devices may be provided. The metal plate 132 may be round as shown or may be formed as a strip or may be provided in other shapes. The metal plate 132 may be bare metal, anodized, coated, painted or otherwise colored to a matching or contrasting color compared to the ceiling 24. A metal structure already in the facility such as a window frame, skylight frame, exposed overhead ceiling fixture or support, or other metal or ferromagnetic material may be used for magnetically attaching the display holder 30. The display holder 30 may be mounted in a window frame or on a ceiling grid perimeter or to a soffit, for example.

The display holder 30 may be mounted to a ceiling grid element at the perimeter of the ceiling. The offset grip portion 48 permits the gripper 28 to position the display holder 30 near or flush against the wall without requiring a space 38 to provide access to sign mounting devices thus potentially limiting the size of the sign or display or the maximum height that the sign can be hung from the ceiling.

Figure 10:
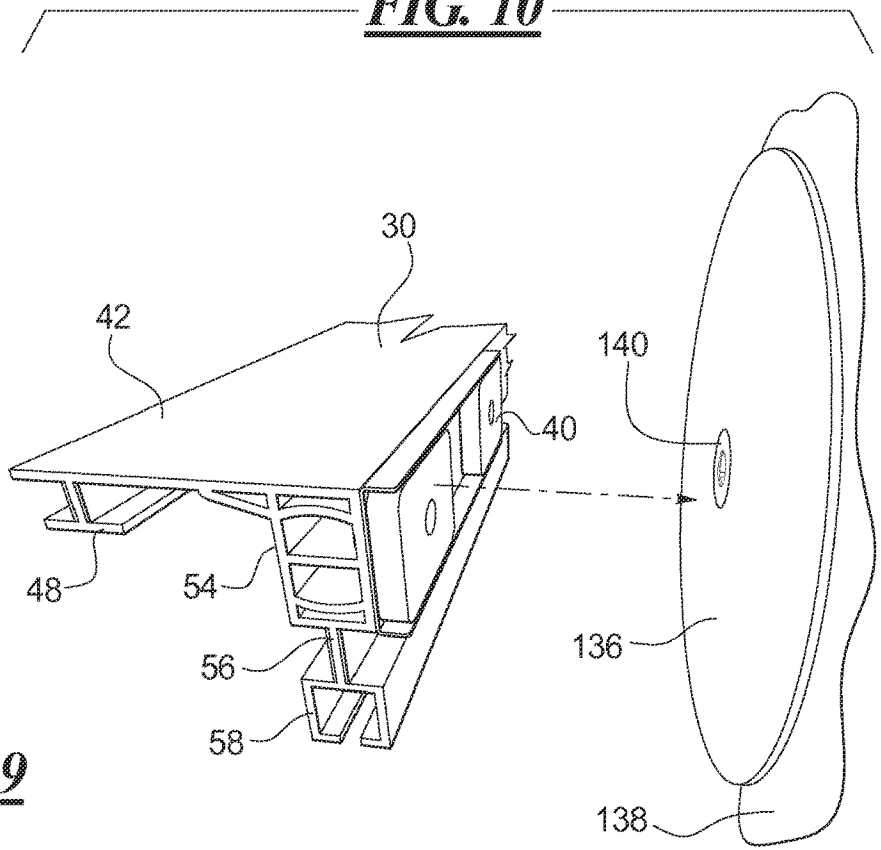
FIG. 10 is a perspective view of a portion of the offset display holder being mounted to a metallic wall disk.

FIG. 10 shows an embodiment of the display holder 30 in which the magnets 40 are provided on the brace 54 instead of, or in addition to, magnets at the top surface 42. A magnetically active vertical surface may be provided for mounting the display holder 30 magnetically. For example, a metal plate 136 is mounted on a wall 138. One or several metal plates 136 may be mounted to the wall 138 by a screw or bolt 140 or other means. A metal strip or other shapes may be provided at the wall instead. The display or sign is mounted to the wall 138 by magnetic attraction. The present embodiment of the display holder 30 may also be mounted to magnetically active support columns, pallet rack uprights, cross members, racks or other metal fixtures that have front facing surfaces that are vertical in orientation. Other means for mounting the holder 30 to a vertical or horizontal surface are within the scope of the present invention.

Figure 11:
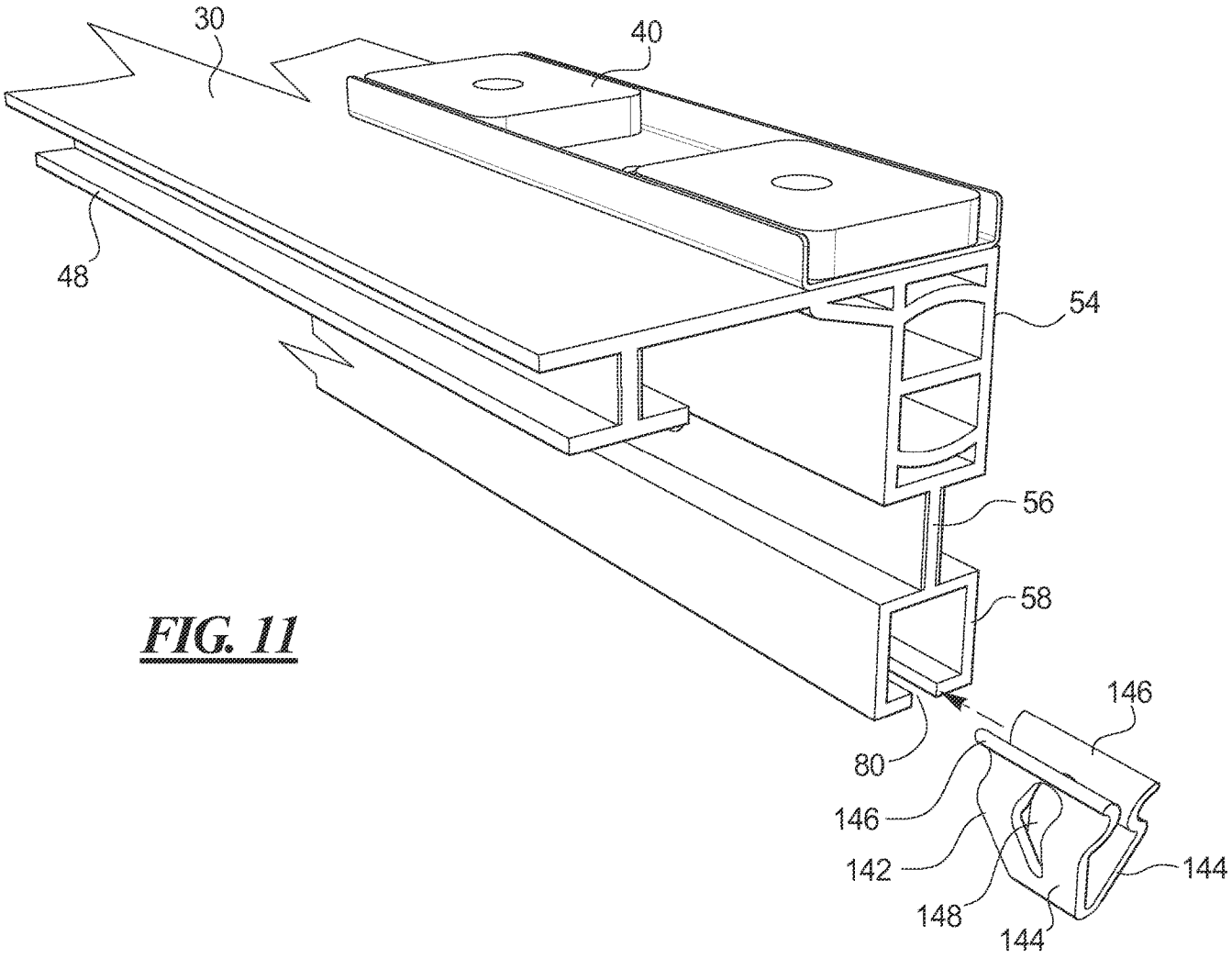
FIG. 11 is a perspective view of a portion of the offset display holder with a clip.

A clip 142 as shown in FIG. 11 may be provided. The clip 142 has two arms 144 that have curved outward ends 146 that frictionally fit into the C-channel 58 so that the clip 142 extends out of the C-channel 58. A hole 148 is provided in each arm 144. The holes 148 are provided for receiving a hook, wire, ring, string, cord, chain, or cable or other hanging hardware for hanging a sign or display. One or several clips 142 may be provided in the C-channel 58 at any desired spacing for hanging or mounting a sign or display.

As is apparent to those of skill in this art, other mounting hardware for mounting a sign or display with the holder 30 are also possible and are within the scope of this invention.

Figure 12:
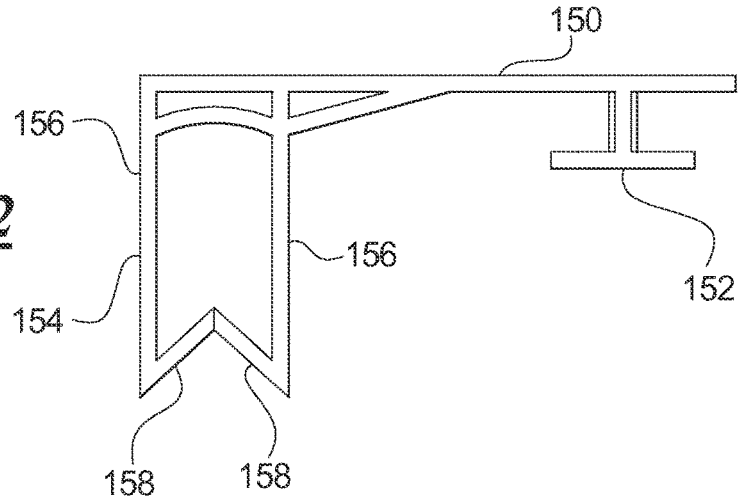
FIG. 12 is an end view of a further embodiment of the offset display holder.

In FIG. 12, an offset display holder 150 has a grip portion 152 offset from a banner holder 154. The banner holder 154 includes two generally parallel walls 156 with inwardly directed end portions 158 between which a top edge of a banner, sign or display is positioned for friction fit. The end portions 158 are in contact, or nearly so, to hold a banner or other display. The holder 150 may be provided with magnets on top or on the back to magnetically engage a surface.

Figure 13:
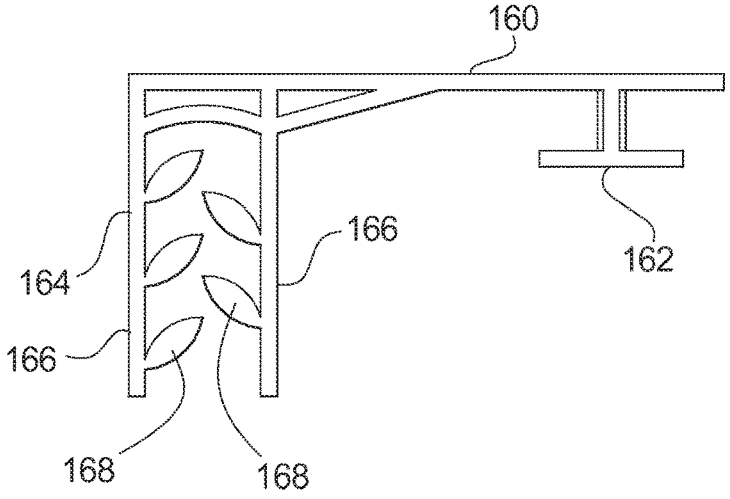
FIG. 13 is an end view of another embodiment of the offset display holder.

In FIG. 13, an offset display holder 160 has a grip portion 162 that is offset from a banner holder 164. The banner holder includes two generally parallel walls 166 with inwardly directed flexible fins 168. The fins 168 bear against a banner or other display to hold the banner in place. The holder 160 may be provided with magnets on top or on the back to magnetically engage a surface.

Figure 14:
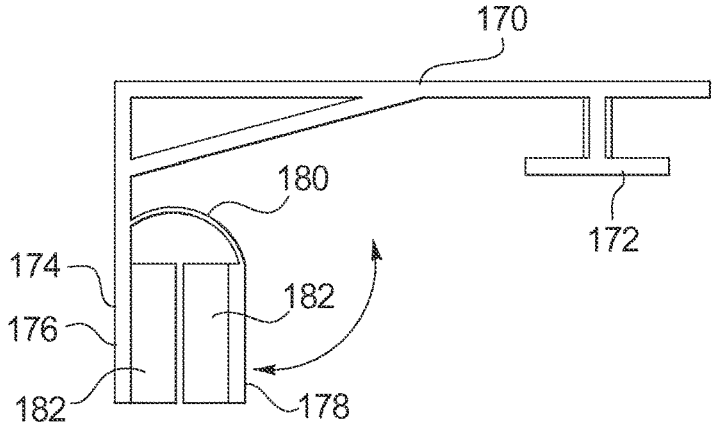
FIG. 14 is an end view of yet another embodiment of the offset display holder.

In FIG. 14, an offset display holder 170 has a grip portion 172 that is offset from a banner holder 174. The banner holder 174 has a fixed wall 176 and a movable wall 178 that is connected to the fixed wall by a flexible hinge 180. Two magnet strips 182 are on the walls 176 and 178. The magnet strips 182 are magnetically attracted to one another to hold a banner or other display between the magnets 182. The banner may be removed by pivoting the movable wall 178 away from the fixed wall 176. The holder 170 may be provided with magnets on top or on the back to magnetically engage a surface.

Figure 15:
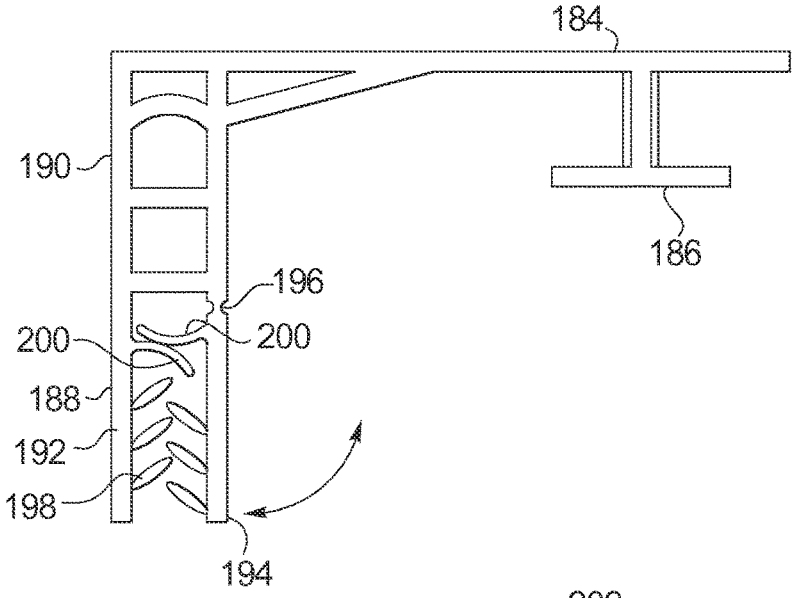
FIG. 15 is an end view of yet a further embodiment of the offset display holder.

FIG. 15 is an offset display holder 184 with a grip portion 186 offset from a banner holder 188. The banner holder 188 has a brace 190 that supports a fixed wall 192 and a movable wall 194. The movable wall 194 is attached to the brace by a hinge 196. The walls 192 and 194 include inwardly directed fins 198. A two part catch formed of two generally cylindrical portions 200 extend inwardly from the walls 192 and 194 that engage one another to hold the walls 192 and 194 in a closed position and to permit the movable wall 194 to be pivoted out when the force of the catch is overcome to permit insertion and/or removal of a banner or other display. The holder 184 may be provided with magnets on top or on the back to magnetically engage a surface.

Figure 16:
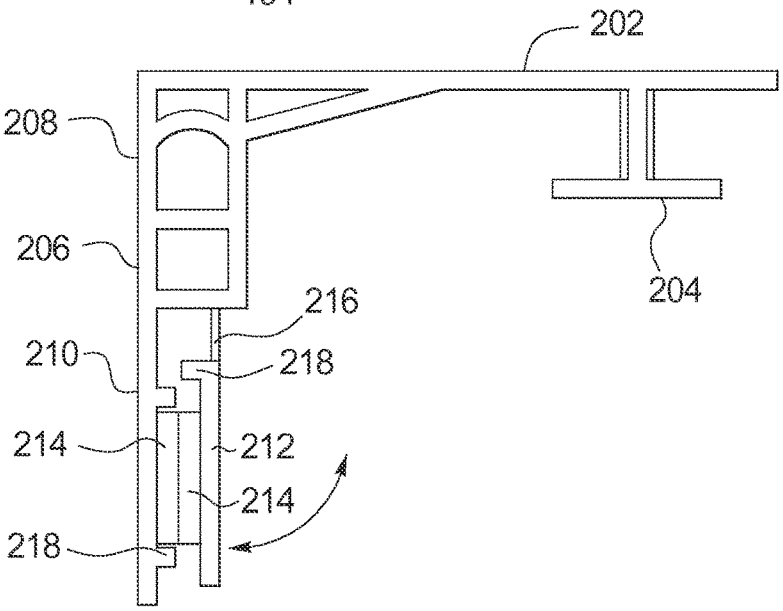
FIG. 16 is an end view of still another embodiment of the offset display holder.

In FIG. 16, an offset display holder 202 has a grip portion 204 offset from a banner holder 206. The banner holder 206 has a brace 208 that supports a fixed wall 210 and a movable wall 212. The walls 210 and 212 have magnet strips 214 attached on their inside surfaces that are magnetically attracted toward one another to hold a banner or other display between the magnets 214. A hinge 216 is flexible to permit the movable wall 212 to move away from the fixed wall 210 so that a banner or other display may be inserted and/or removed. The magnet strips 214 are held in retainer strips 218 mounted on the inside surfaces of the walls 210 and 212. The holder 202 may be provided with magnets on top or on the back to magnetically engage a surface.

Figure 17:
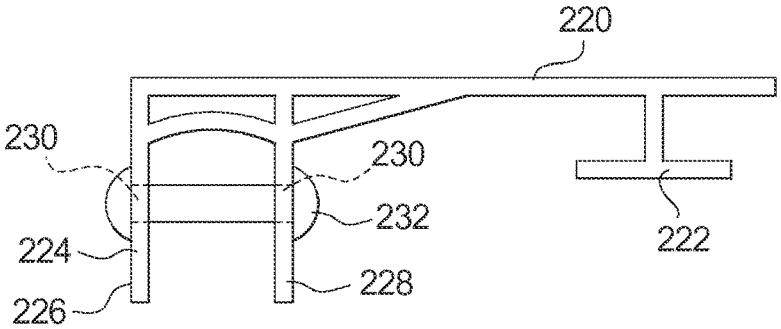
FIG. 17 is an end view of still a further embodiment of the offset display holder.

In FIG. 17, an offset display holder 220 has a grip portion 222 that is offset from a banner holder 224. The banner holder 224 includes two generally parallel walls 226 and 228 that include holes 230 through both walls 226 and 228 in alignment. A retainer pin 232 is passed through both holes 230 and through a like hole near the top edge of a banner or other display to hold the banner or display in the banner holder 224. A plurality of pins 232 may be provided along the length of the banner holder 224. The retainer pin 232 may be a pin, bolt, screw, rivet or other fastener or retainer to hold a sign or banner in the holder 224. The holder 220 may be provided with magnets on top or on the back to magnetically engage a surface.

Other banner or display holders may be provided in the offset display holder within the scope of this invention.

Thus, there is shown and described a display holder that includes, in certain embodiments, an extruded member having a top surface from which extends a T-shaped grip portion for engagement by a gripper at the end of a pole. Spaced from the grip portion is a brace on the end of which is a web connected to a C-channel. The C-channel receives a display or sign, such as a dowel in a sleeve of the display, a display suspended from a block end hook, a display suspended from a cord suspender, or a display suspended from a clip. A ring, hook, wire, chain, string, cable, cord, or other hanging hardware may be attached through a hole in the web to suspend a display. The display holder may be mounted or un-mounted in one single motion to a ceiling by magnets positioned on the top surface of the holder or to a wall by magnets positioned on a side of a the brace of the holder.

The present holder may include a rotating member to permit the portions of the holder to rotate relative to a mounting location. The present holder may include open hooks or other devices in place of the magnets for mounting at a mounting location.

The apparatus as disclosed herein may be provided in various embodiments within the scope of the present invention. Methods, such as method for mounting and/or un-mounting signs or displays, are also disclosed herein and are within the scope of the present invention.

Although other modifications and changes may be suggested such as certain variation that can turn signs or displays 360 degrees for optimum viewing angles or having shepherd shaped open hooks on the top surface or plate in place of magnets for use when open suspension ceilings are encountered by those skilled in the art, it is the intention of the inventors to embody within the patent warranted hereon all changes and modifications as reasonably and properly come within the scope of their contribution to the art.

I claim:

1. A display device, comprising:

an elongated body including a top plate extending a length of the elongated body, the top plate having a top surface and a bottom surface opposite the top surface;

a first grip portion extending from the top plate, the first grip portion extending the length of the elongated body, the first grip portion being configured for gripping on opposite sides of the first grip portion by a gripper, the first grip portion including a first support web defining a planar portion extending from the bottom surface of the top plate in a direction perpendicular to the top surface of the top plate, the first support web having the opposite sides configured for gripping by the gripper, the first grip portion including a cross web connected to the first support web, the cross web including a portion disposed parallel to the top surface of the top plate, the cross web being spaced from and disposed below the bottom surface of the top plate so that the opposite sides configured for gripping by the gripper are disposed between the cross web and the top plate;

a brace extending from the top plate and spaced from the first grip portion, the brace extending the length of the elongated body;

a second support web extending from the brace at portion of the brace opposite the top plate, the second support web extending the length of the elongated body, the second support web providing a second grip portion, the second grip portion being configured for gripping on opposite sides of the second grip portion by the gripper, the second grip portion being configured for being gripped by the same gripper as the first grip portion, the second grip portion being spaced from the first grip portion; and a C-channel connected to the second support web, the C-channel defining an interior space, the C-channel defining a gap opening into the interior space, the C-channel extending the length of the elongated body.

2. A display device as claimed in claim 1, further comprising:

a magnet affixed to the elongated body at a position spaced from the first and second support webs to provide access to the first and second support webs by a gripper when the elongated body is magnetically affixed to a surface.

3. A display device as claimed in claim 2, wherein the magnet is affixed to the top plate.

4. A display device as claimed in claim 2, wherein the magnet is affixed to the brace.

5. A display device as claimed in claim 1, further comprising:

a dowel disposed in the C-channel, the dowel being disposed within an elongated sleeve at a top edge of a sign or display, the elongated sleeve extending about the dowel in the C-channel.

6. A display device as claimed in claim 1, further comprising:

at least one of a block end hook mounted in the C-channel, a cord suspender mounted in the C-channel, or a clip mounted in the C-channel.

7. A display device as claimed in claim 1, further comprising:

an end cap having a pair of arms connected to the second support web and having an end plate covering an end of the C-channel, the pair of arms being connected to the second support web outside of the C-channel.

8. A display device as claimed in claim 1, further comprising:

a ring thru a hole in the second support web.

9. A display device as claimed in claim 1, further comprising:

at least one metal plate configured for mounting on one of a ceiling or a wall; and a magnet on the elongated body for magnetically engaging the at least one metal plate.

10. A display device as claimed in claim 9, wherein the at least one metal plate includes a plurality of metal plates, and the magnet including a plurality of magnets mounted to the elongated body at spaced locations.

11. A display device as claimed in claim 1, further comprising:

a pole;

the gripper mounted on an end of the pole, the gripper being configured to grip the opposite sides of the first grip portion in a first grip position and being configured to grip the opposite sides of the second grip portion in a second grip position, the gripper being configured to extend over the cross web of the first grip portion when in engaged contact with the opposite sides of the support web, the gripper having first and second jaws disposed between the cross web and the top plate when in the engaged contact with the opposite sides of the support web; and a release apparatus for releasing the gripper from the first and second grip portions.

12. A display device as claimed in claim 1, wherein the first grip portion is of an inverted T shape in cross-section.

13. A display device as claimed in claim 1, wherein the cross web is connected at a midpoint of the cross web to the first support web.

14. A display device as claimed in claim 1, wherein the cross web is at a right angle to the first support web.

15. A display device as claimed in claim 14, wherein the first support web is at a right angle to the top plate.

16. A display device as claimed in claim 1, wherein the cross web is planar.

17. A display device, comprising:

an elongated body including a top plate extending a length of the elongated body, the top plate having a bottom surface;

a first grip portion extending from the bottom surface of the top plate, the first grip portion extending the length of the elongated body, the first grip portion being configured for gripping on opposite sides of the first grip portion by a gripper, the first grip portion including a support web extending perpendicular from the bottom surface of the top plate, the support web having the opposite sides configured for gripping by the gripper, the first grip portion including a cross web connected to the support web, the cross web including a portion disposed parallel to the top plate, the cross web being spaced from the bottom surface of the top plate so that the opposite sides configured for gripping by the gripper are disposed between the cross web and the bottom surface of the top plate;

a brace extending from the top plate and spaced from the first grip portion, the brace extending the length of the elongated body; and a display holder mounted to the brace, the display holder being spaced from the first grip portion by the top plate.

18. A display device as claimed in claim 17, wherein the display holder includes first and second members extending from the brace, the first and second members being configured for holding an edge of a sign or display between the first and second members.

19. A display device as claimed in claim 18, wherein the first and second members include inner surfaces configured for gripping the edge of the sign or display.

* * * * *